United States Patent [19]

Fuchs et al.

[11] Patent Number: 4,917,269

[45] Date of Patent: Apr. 17, 1990

[54] LIQUID CONTAINING AND DISPENSING PACKAGE

[75] Inventors: Timothy J. Fuchs, Perrysburg; William E. Fillmore, Toledo; Eugene F. Haffner, Maumee, all of Ohio

[73] Assignee:- Owens-Illinois Closure Inc., Toledo, Ohio

[21] Appl. No.: 349,676

[22] Filed: May 10, 1989

[51] Int. Cl.[4] ..... B67D 1/16

[52] U.S. Cl. ..... 222/109; 141/381; 215/DIG. 1; 222/111; 222/562

[58] Field of Search ..... 222/108–111, 222/566–570, 546, 549, 551, 562, 563; 141/379–381; 215/31, 228, DIG. 1, DIG. 7

[56] References Cited

U.S. PATENT DOCUMENTS

| | | | |
|---|---|---|---|
| 2,763,403 | 9/1956 | Livingstone | 222/111 |
| 3,422,998 | 1/1969 | Murray | 222/567 |
| 3,595,421 | 7/1971 | Sanchis | 215/DIG. 1 X |
| 4,542,833 | 9/1985 | DeVaughn | 215/DIG. 1 X |
| 4,550,862 | 11/1985 | Barker et al. | 222/109 |

FOREIGN PATENT DOCUMENTS

| | | | |
|---|---|---|---|
| 0214675 | 3/1987 | European Pat. Off. | 222/109 |
| WO80/01061 | 5/1980 | World Int. Prop. O. | 215/DIG. 1 |

*Primary Examiner*—Kevin P. Shaver

[57] ABSTRACT

A liquid containing and dispensing package comprising a hollow plastic container having a neck comprising an upwardly extending integral dispensing spout, an integral web extending radially outwardly from the lower end of the dispensing spout and a cylindrical wall spaced radially outwardly of the spout and encircling the spout. The cylindrical wall has an internal thread, a closure having a base wall and peripheral wall with an external thread applied to the container. The closure includes an annular flexible sealing ring that engages the inner surface of the cylindrical wall and flexes upwardly to provide a seal. A sealing ring extends radially outwardly intermediate the peripheral wall and engages the top of the cylindrical wall when the closure is threaded onto container.

5 Claims, 3 Drawing Sheets

LIQUID CONTAINING AND DISPENSING PACKAGE

This invention relates to liquid containing and dispensing packages and particularly to such packages which include a pouring spout and a closure that functions as a measuring cup.

BACKGROUND AND SUMMARY OF THE INVENTION

In one type of liquid dispensing package, a pouring spout fitment is positioned on the neck of the container and a closure in the form of the cup is interengaged with the periphery of the neck. More specifically, a spout is mounted in a first fitment that snaps onto the neck.

U.S. Pat. No. 4,671,421 shows a plastic container which comprises a plastic blow molded container having an annular finish, an insert positioned in the finish and interengaged with the internal surface of the finish. The insert has internal threads for receiving an enlarged closure in the form of a self-draining measuring cup having external threads on the lower end thereof and a peripheral flange sealingly engaging the free end of the finish.

U.S. Pat. No. 4,640,855 shows a plastic container with an integral spout comprising a hollow body, a neck having an outer wall and an inner wall formed with internal threads and a spout connected to the inner wall and extending outwardly of the container. The container is formed by blow molding to form the hollow body, a neck forming portion extending from the hollow body and a spout forming portion extending from the neck forming portion. Thereafter, the neck forming portion is heated and the spout is moved inwardly of the hollow body to reform the neck forming portion into the inner and outer wall. Thereafter, the threads are pressed internally on the inner wall of the neck. Alternatively, the threads may be formed during the blow molding.

U.S. Pat. No. 4,706,829 discloses a liquid containing and dispensing package comprising a hollow plastic container having a neck, a fitment interengaging the neck and a closure. The fitment interengages the neck and as a first peripheral portion extending axially and having a portion defining a spout having a pouring lip extending axially inwardly of the end of the neck. The closure comprises a top wall and a first peripheral wall extending from the top wall axially inwardly. The closure includes a radial portion extending from tne peripheral wall and sealingly engaging an annular area of the fitment. The closure defines a dispensing cup and includes a second outer peripheral wall spaced from the first peripheral wall which has internal threads engaging external threads on the neck of the container.

U.S. patent application Ser. No. 160,478 filed Feb. 25, 1988, having a common assignee with the present application, discloses a container for use in a liquid and dispensing package wherein the container includes a body portion which terminates in an opening through which the contents can be dispensed. An integrally formed neck and dispensing portion extends from and communicates with the body portion. The dispensing portion includes a wall which extends around the body opening. An integral dispensing spout is located within and encircled by the wall. The upper end of the dispensing spout extends above the top of the collar. A web portion extends between the collar and the dispensing spout.

The exterior of the spout, the web and the collar define a channel into which fluid may be received when the container is inverted. A drain opening is provided in or adjacent the bottom of the channel through which the fluid in the channel may drain back into the body of the container when the container is uprighted.

When a closure is applied to such a container, it has been found that a relatively rigid closure tends to flex or expand the wall which surrounds the spout and has internal threads engaged by external threads on the closure. Any rigid sealing member on the wall or closure tends to also flex or expand the wall resulting in a loss of threaded engagement.

Among the objectives of the present invention are to provide a liquid containing and dispensing package which utilizes the container of the type disclosed in the aforementioned U.S. application and provides further that the closure is constructed and arranged to provide a leak-resistant seal between the closure and the finish or neck of the container.

In accordance with the invention, a liquid containing and dispensing package comprising a hollow plastic container having a neck comprising an upwardly extending integral dispensing spout, an integral web extending radially outwardly from the lower end of the dispensing spout and a cylindrical wall spaced radially outwardly of the spout and encircling the spout. The cylindrical wall has an internal thread, a closure having a base wall and peripheral wall with an external thread applied to the container. The closure includes an annular flexible sealing ring that engages the inner surface of the cylindrical wall and flexes upwardly to provide a seal. A sealing ring extends radially outwardly intermediate the peripheral wall and engages the top of the cylindrical wall when the closure is threaded onto container.

DESCRIPTION

Figure 1:
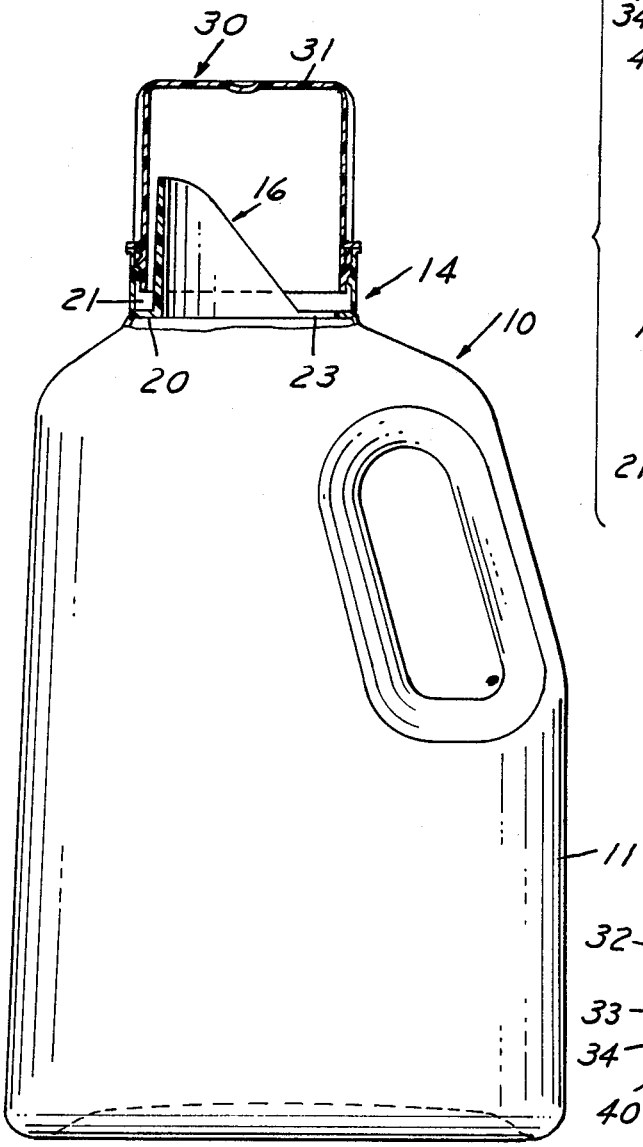
FIG. 1 is a part-sectional elevational view of a liquid containing and dispensing package embodying the invention.
Figure 2:
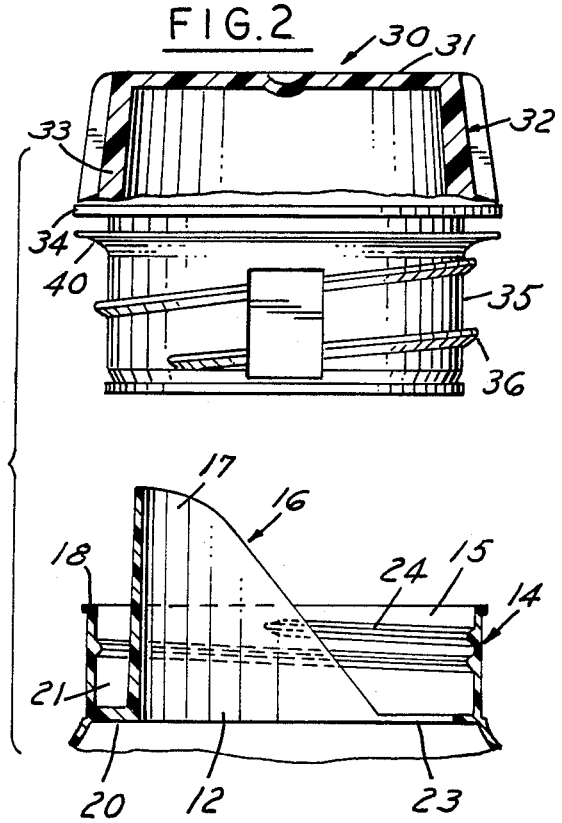
FIG. 2 is a fragmentary part-sectional exploded view of the closure and a part of the container of the package.
Figure 3:
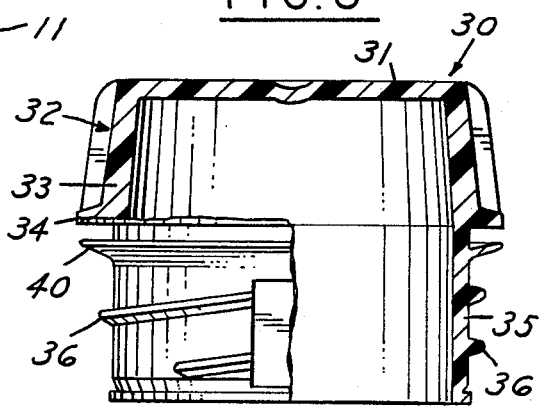
FIG. 3 is a part-sectional elevational view of the closure.
Figure 4:
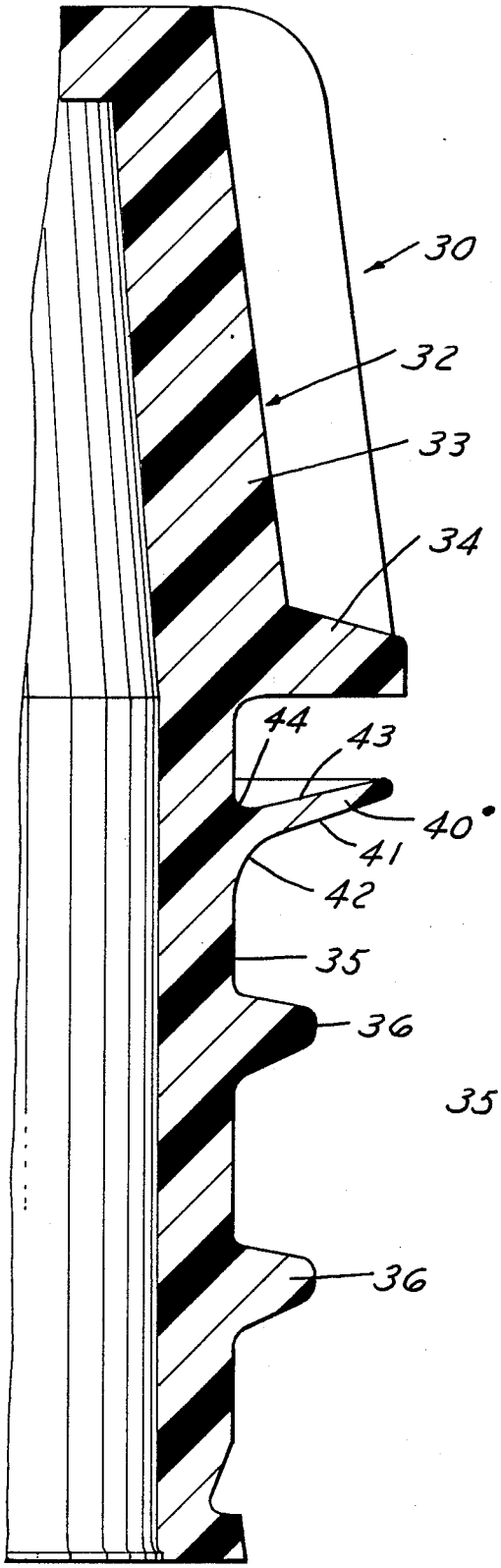
FIG. 4 is a fragmentary sectional view on an enlarged scale of a portion of the closure.

The container utilized in the present invention is of the type disclosed and claimed in the aforementioned application, the disclosure of which is incorporated herein by reference. Specifically, the self-draining container 10 includes a body portion 11 which terminates in an opening 12 through which the contents of the container 10 can be dispensed.

An integrally formed neck and dispensing portion 14 extends from and communicates with the body portion 11. The dispensing portion 14 includes a circular axial wall 15 which extends annularly around the body opening 12. An axially extending dispensing spout 16 is located within and is encircled by the wall 15. The dispensing spout 16 includes an upper end 17 which extends above a top 18 of the wall 15.

A connecting radial web 20 extends between the wall 15 from an elevation below the top 18 to the dispensing spout 16. The web 20 connects the wall 15 and the dispensing spout 16 to define a channel 21 into which fluid flowing from the exterior of the dispensing spout 16 may drain when the container 10 is uprighted after it has been inverted for pouring. The web 20 extends at least halfway around the dispensing spout 16 to prevent flow of liquid into the channel 21 when the container 10 is partially inverted to a pouring position.

A drain opening 23 is provided adjacent the channel 21. Fluid which is received in the channel 21 may drain back into the body 11 of the container 10 after the container is uprighted subsequent to pouring.

Threads 24 are formed on the inside surface of the circular wall 15. A closure or cap 30 includes a top or base wall 31 and a depending annular peripheral wall 32. A second sealing ring 34 extends radially outwardly from the upper portion 33 of wall 32 and a cylindrical skirt portion 35 depends downwardly below the ring 34. External threads 36 are formed on the exterior surface of the skirt 35 and cooperate with the internal threads 24 defined on the interior wall 15 of the container 10.

Figure 5:
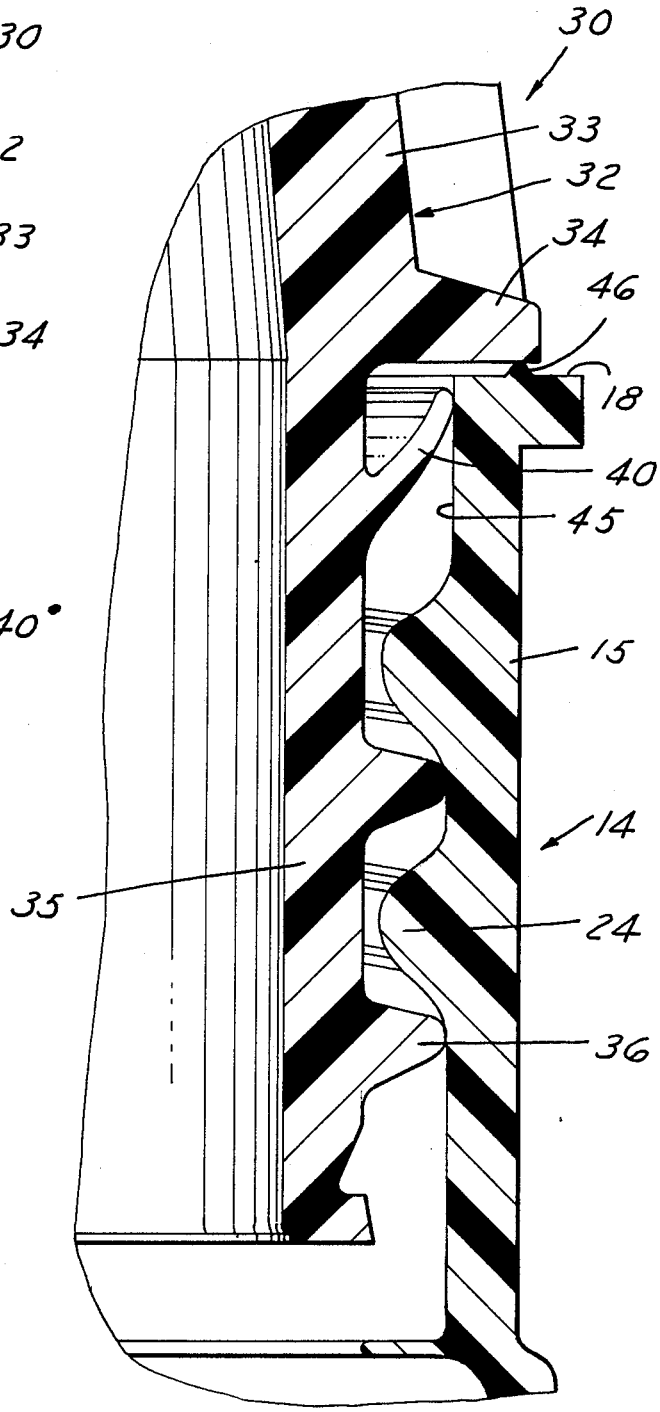
FIG. 5 is a fragmentary sectional view on an enlarged scale of the closure assembled on the container.

As disclosed in the aforementioned patent application, referring to FIG. 5, the self-draining container 10 may be produced within the normal cycle of blow molding machine of a type used by the assignee of the present invention known as a BC-3 machine. No post-molding operations are needed to produce the desired self-draining finish on this type of machine. Details of a BC-3 machine method are disclosed in Sherman U.S. Pat. No. 2,804,654, which is incorporated herein by reference. This type of blow molding may be characterized as injectionextrusion blow molding and is used by the assignee of the present invention and others with a machine designated as a BC-3.

In the method utilized by the BC-3 machine, tne upper neck or finish portion of the container is first injection molded in an injection mold. Upon completion of the injection molding step, the injection mold is raised from the orifice of the injection die head while a length of heated and plastircized tubing is extruded from the die head. The tubing is connected integrally to the injection molded finish and is drawn upwardly as the tubing is extruded. After the proper length of tubing has been extruded, blow mold halves close around the tubing and air is introduced through the injection mold assembly to expand the tubing in the closed mold to form the remainder of the container. These steps are shown as described in U.S. Pat. No. 2,804,654.

In accordance with the invention, a primary and flexible sealing ring 40 is provided on the outer surface of the lower portion 35 of the wall 32 of the closure. Sealing ring 40 extends at an angle outwardly and upwardly from the outer surface of the wall portion 35 at the area between the secondary sealing ring 34 and the threads 36. The sealing ring 40 includes a lower surface 41 which is connected to the outer surface of the wall portion 35 by an arcuate portion 42. The sealing ring 40 further includes an upper surface 43 that is inclined upwardly and outwardly and is connected to the wall 35 by an arcuate surface 44 having a lesser radius than the surface 42. By this arrangement, the sealing ring 40 is constructed and arranged so that it will naturally flex upwardly and inwardly into sealing contact with the inner surface 45 of the wall 15 of the container when the closure is threaded on the container. The provision of the larger radius of the surface 42 permits the proper flexing without stress cracking of the plastic as well as preventing inadvertent inversion of the lip when the closure is removed.

It has been found that such an arrangement insures a proper seal of the liquid contents of the container. In order to facilitate the secondary seal of the flange or rib 34, an annular bead 46 can be provided on the upper surface 18 of the wall 15. The bead tends to exclude dirt or foreign matter from entering the container.

Figure 6:
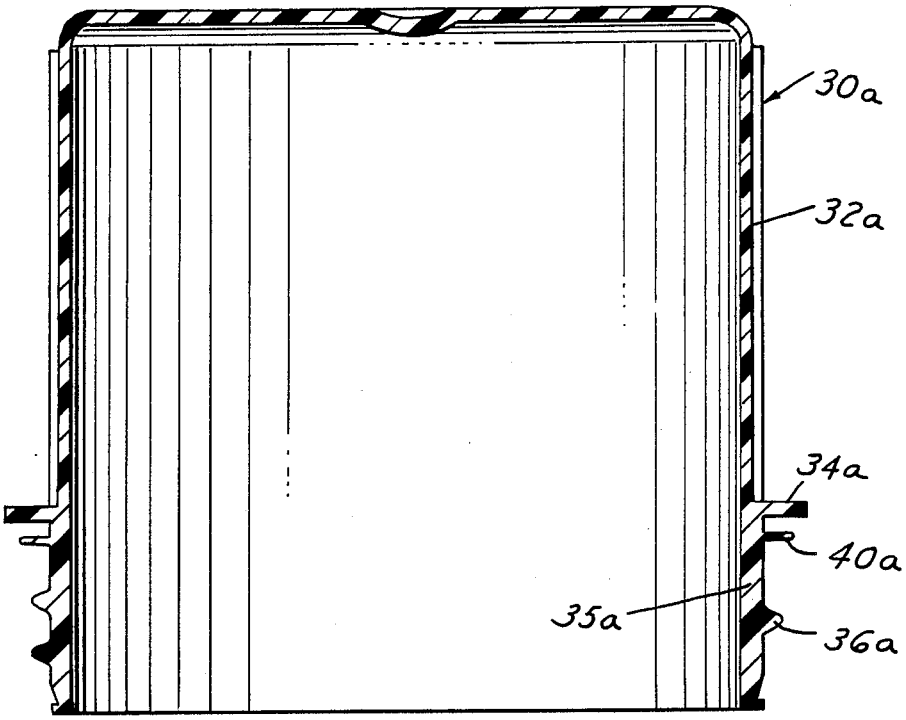
FIG. 6 is a sectional elevational view of a modified form of closure.
Figure 7:
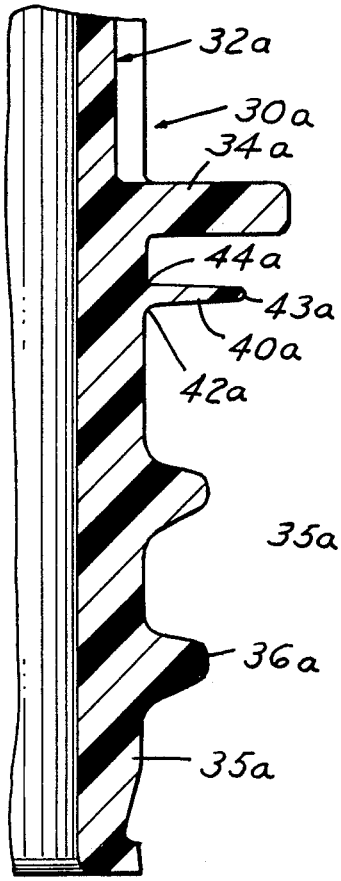
FIG. 7 is a fragmentary sectional view on an enlarged scale of a portion of the closure shown in FIG. 6.
Figure 8:
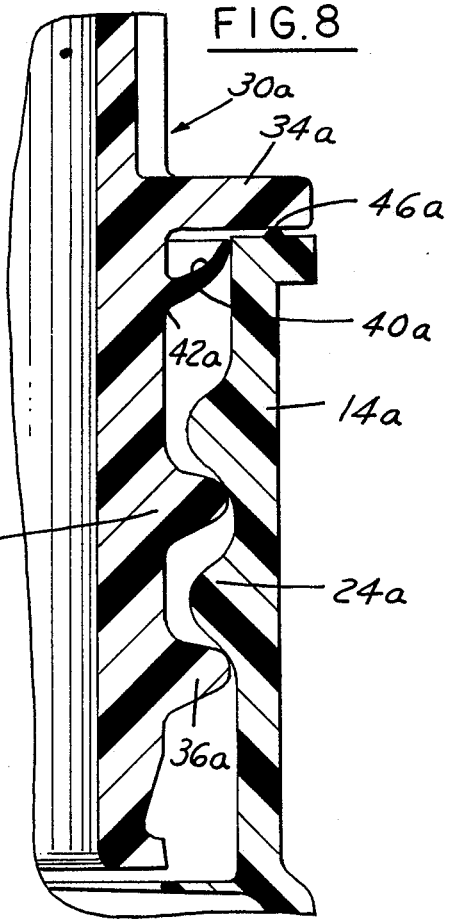
FIG. 8 is a fragmentary sectional view on an enlarged scale showing the closure of FIGS. 6 and 7 assembled to a container.

In the form shown in FIGS. 6–8, corresponding parts are connected by comparable reference numerals with the suffix a. In this form the flexible seal 40a extends transversely or horizontally and has surfaces **41*a*, 43*a* as well as connecting arcuate surfaces 42*a*, 44*a*, the surface 42*a* having the greater radius than the surface 44*a***.

Satisfactory plastic materials which can be used for the closure and container comprise high density polyethylene or polypropylene, homopolymers and copolymers.

It has been found that in accordance with the invention, a seal is provided which effectively seals the closure and container without flexing or distorting the wall 15.

We claim:

1. A liquid containing and dispensing package comprising:

a plastic container having a neck defining an inner spout and an outer annular wall surrounding the spout and spaced radially outwardly for said spout, said outer wall having an internal thread on the inner surface thereof, a plastic closure including a base wall, a peripheral wall having a free edge and external threads on the outer surface of the peripheral wall, and a radial flange intermediate the base wall and the free edge above the threads, said internal threads on said outer wall of said container engaging said external threads on said container and said radial flange on said container engaging said outer wall of said container, said closure including and integral flexible radially outwardly extending sealing lip positioned on the outer surface of the peripheral wall above the external threads and extending radially lineal and closely adjacent said flange such that upon threading of the closure on the container the sealing lip flexes upwardly upon engagement with the inner surface of the outer wall of the container to seal the container adjacent said flange and above said threads.

2. The package set forth in claim 1 wherein said sealing lip is tapered.

3. The package set forth in claim 2 wherein said sealing lip is connected to the peripheral wall of the closure by a lower arcuate surface connecting the undersurface of the lip with the wall and an upper arcuate surface connecting the upper surface of said lip with said wall, said lower arcuate surface having greater radius than the upper arcuate surface.

4. The package set forth in claim 3 wherein said sealing lip extends radially outwardly and axially toward the flange.

5. The package set forth in claim 3 wherein said sealing lip extends radially outwardly substantially a right angle to the axis of the closure.

* * * * *

UNITED STATES PATENT AND TRADEMARK OFFICE

CERTIFICATE OF CORRECTION

PATENT NO. : 4,917,269

DATED : Apr. 17, 1990

INVENTOR(S) : Timothy J. Fuchs, William E. Fillmore, Eugene F. Haffner

It is certified that error appears in the above-identified patent and that said Letters Patent is hereby corrected as shown below:

Column 4, lines 40 and 41, "container" should be --closure--

Column 4, line 42, "container" should be --closure--

Column 4, line 47, "lineal" should be --beneath--

Signed and Sealed this

Eighth Day of February, 1994

Bruce Lehman

*Attest:*

BRUCE LEHMAN

*Attesting Officer*

*Commissioner of Patents and Trademarks*